United States Patent [19]

Soobik

[11] 4,005,404

[45] Jan. 25, 1977

[54] CIRCUIT FOR CONTROLLING A DISPLAY DEVICE

[75] Inventor: Lembit Soobik, Kranzberg, Germany

[73] Assignee: Texas Instruments Incorporated, Dallas, Tex.

[22] Filed: Oct. 23, 1975

[21] Appl. No.: 625,357

[30] Foreign Application Priority Data

Oct. 29, 1974 Germany ..... 2451237

[52] U.S. Cl. ..... 340/336; 340/166 EL; 340/324 M

[51] Int. Cl.² ..... G09F 9/32

[58] Field of Search ..... 340/336, 166 EL, 168 S, 340/324 M; 178/15, 30; 350/160 LC; 315/169 TV

[56] References Cited

UNITED STATES PATENTS

| | | | |
|---|---|---|---|
| 3,863,247 | 1/1975 | Hosokawa | 340/336 |
| 3,914,758 | 10/1975 | Ingle | 340/336 |
| 3,918,041 | 11/1975 | Mao | 340/336 |
| 3,925,690 | 12/1975 | Spence | 340/336 |
| 3,950,743 | 4/1976 | Hatano et al. | 340/336 |

*Primary Examiner*—Marshall M. Curtis
*Attorney, Agent, or Firm*—Harold Levine; James T. Comfort; Richard L. Donaldson

[57] ABSTRACT

A multi-character display comprising a plurality of segmented display devices and a control circuit for actuating the individual display devices in time sequence and for tuning on individual segments of an enabled display device in time sequence. The segments and devices are turned off in the same sequence. By suitable selection of the frequency of operation, a viewer perceives a complete display. Reduction of the switching current to that needed for activation of a single element reduces the turn on noise and makes the display particularly suitable for use in TV and radio receivers.

9 Claims, 2 Drawing Figures

CIRCUIT FOR CONTROLLING A DISPLAY DEVICE

The invention relates to a circuit for controlling a display device with which different characters can be indicated by applying control signals selectively to display segments, with a segment control circuit which generates segment control signals at its outputs associated with particular display segments, depending on the characters to be indicated.

In these control circuits the control signals usually generated by the segment control circuit are applied simultaneously to the display segments, which light up to indicate a certain character. With each display, the current required to excite those display segments to which the control signals are applied must thus be simultaneously switched on or switched off. Since this current can assume relatively high values, depending on the number of display segments to be excited, HF interference is produced when this current is switched on or off, which interference is undesired in many applications of display devices. If such a display device is installed, for example, in a radio receiver, such HF interference can lead to a considerable degradation in reception.

The HF interference diminishes when the current supplied to the display segments is reduced, but this leads necessarily to an undesired reduction in brightness of the display.

The invention provides a circuit for controlling a display device such that HF interference generated when the current exciting the display segments is switched on and off, can be substantially reduced without impairing the brightness of the display.

This is achieved according to the invention in that a control circuit is provided which has a number of display segments, at which outputs control signals of equal duration but staggered in time are generated, each of which the application of the segment triggering signals to the respective indicating segment.

In a circuit arrangement according to the invention, the segment control signals are applied successively by means of the staggered control signals to the display segments to be excited, so that the individual currents exciting the display segments are also switched on, staggered in time. Since the individual display segments are thus switched on successively, it is no longer necessary to connect a high current value required for simultaneously triggering several display segments, but only the individual current required for a single display segment. Even if HF interference should still appear in this switching operation, it is of negligible level.

By means of a circuit arrangement embodying the invention, it is possible to use current values required for the desired brightness of the display without generating an undesirable level of HF interference during the switching of these currents.

An advantageous embodiment of the invention comprises a gate circuit having a signal input and control input included in the connection between the output of the segment control circuit and the display segments that the control input is connected to one output of the control circuit and the signal input to one output of the segment control circuit, while the output of the gate circuit is connected to the respective display segment.

Furthermore, the control circuit advantageously is a shift register, having a number of stages (bits) equal to the number of display segments, and having stage outputs connected to the control inputs of the gate circuits. By means of this advantageous design, it is possible to apply the segment control signals appearing at the output of the segment control circuit to the respective display segments under the control of the control signals produced by the stage outputs of the shift register.

In an advantageous manner, a circuit arrangement embodying the invention is so designed that the signal input of the shift register is connected to the output of a switching signal generator, which generates periodic switching signals of a duration which is at least as great as the predetermined duration of voltage application to a display segment, and that the timing input of the shift register is connected to the output of a timing pulse generator, which generates periodic timing impulses whose repetition frequency is high, compared to the repetition frequency of the switching signals.

The shift register operation is controlled by switching signals fed to its data input from the switch signal generator, and is stepped in synchronism with the signal inputs from the timing generator. The signal value of this switching signal is stepped synchronously with the timing impulses for its entire propagation through the shift register, which then produces its stage (bit) outputs, control signals for the duration of the switching signal. Since the signal value of the switching signal from the switching signal generator is shifted in synchronism with the timing pulses, stage by stage, the control signals are also produced staggered in time, so that the supply of the control signals to the indicating segments can only take place successively.

In a multi-character (digit) display device with a common position-control input for all indicating segments of a character, a character control circuit which generates stepping signals, starting the successive application of character control signals to the character control inputs, the segment control signals being switchable, depending on the release of the character control signals for designating the characters to be displayed at the individual character positions, it is provided in a further embodiment of the invention that the duration of the character-control signals is at least equal to the time between the start of the control signals at the output of the first stage of the shift register and the end of the control signal at the output of the last stage of the shift register.

In such an embodiment, the character control circuit includes an OR-gate with two inputs, one of which is connected to the output of the first stage and the other to the output of the last stage of the shift register, a gate circuit with two inputs is provided for each character position of the display device, of which one is connected to the output of the OR circuit and the other to one output of a ring counter which successively generates logic 1 level signals, after reaching a certain count of the shift register, and the outputs of the gate circuits are connected to the character-control inputs of the display device.

In a multi-character display device, the individual characters can be triggered successively in multiplex operation. In this operation, only one character of the multidigit display device is switched on at a particular time. When the successive connection and disconnection of the individual characters takes place sufficiently rapidly, it appears to the eye that the display device is continuously actuated. In this multiplex operation of multi-character display devices, the staggered switching on of the currents for the individual display segments is particularly advantageous, because the individual characters are here constantly connected and disconnected in periodic succession. Use of this arrangement embodying the invention avoids connection and disconnection of high current values, which would otherwise lead to generation of excessive HF interference.

By way of example only, an embodiment of the invention will be described in greater detail with reference to the drawings, in which.

Figure 1:
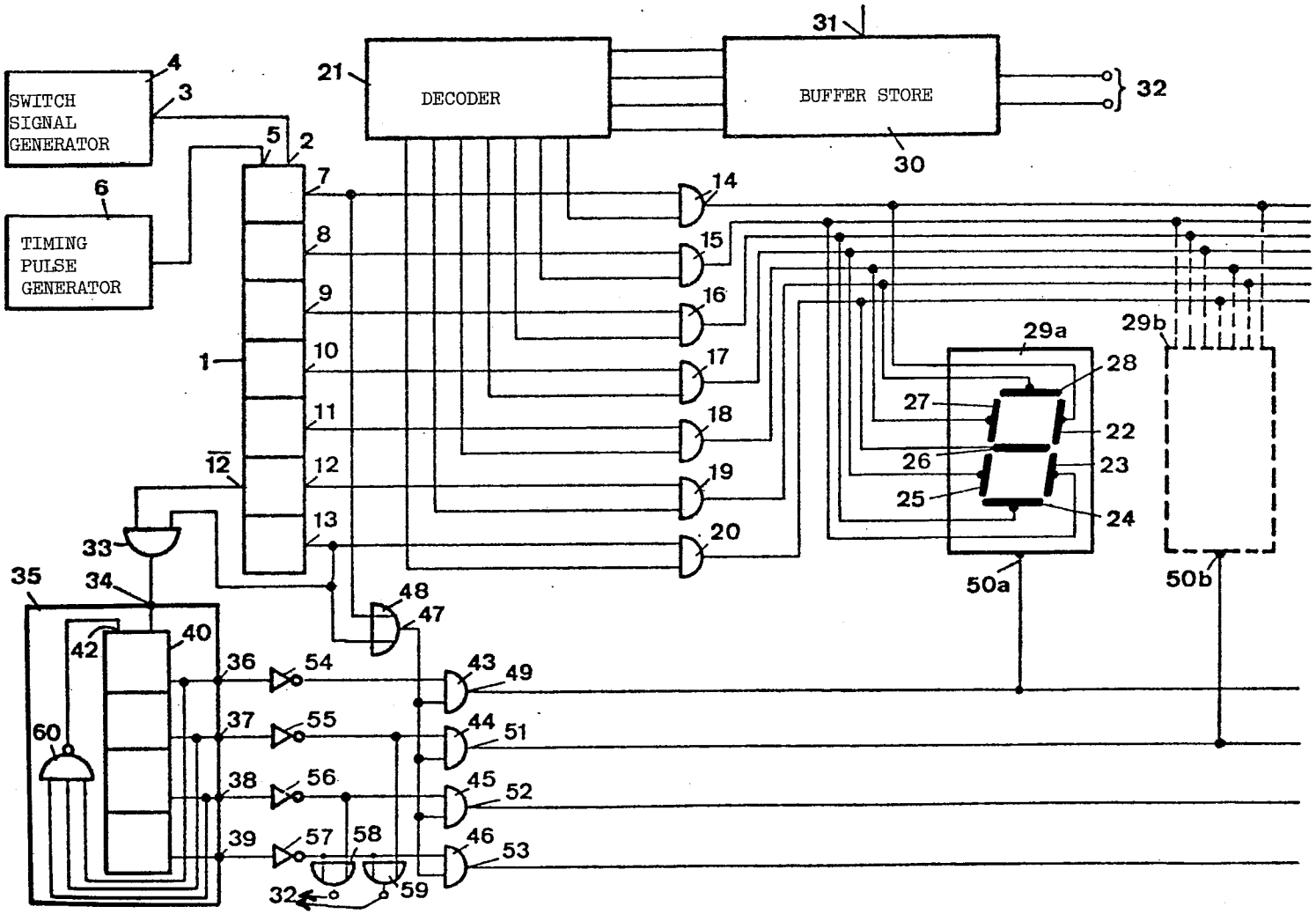
FIG. 1 shows a circuit diagram of control circuit arrangement embodying the invention, where only one display device is represented completely, another being represented schematically to simplify the illustration.

The display device control circuit shown in FIG. 1 includes a shift register 1 with seven stages. The shift register 1 has a signal input 2, which is connected to the output 3 of a switching signal generator 4. Furthermore, the shift register 1 has a timing input 5 to which timing pulses are fed from a timing pulse generator 6.

The direct outputs 7 to 13 of the seven stages of the shift register 1 are connected to the outputs of AND gates 14 to 20, which also have signal inputs connected to the outputs of a decoder 21 acting as a segment control circuit. The outputs of the gates 14 to 20 are connected to corresponding display segments 22 to 28 of a display device 29. The display device 29 is a multi-character (digit) device, but for simplicity's sake only one character 29*a* is represented completely in FIG. 1, and the next character 29*b* is only schematically indicated. A control circuit is shown for a four-character display, having characters 29*a* to 29*d*, which are each connected in the same manner as the character 29*a* shown in FIG. 1, by way of example, it being noted that the invention is applicable to multi-character displays having fewer or more characters. The individual characters of the indicating device 29 are formed by so-called 7-segment displays with which the digits 0 to 9 (as well as alphabetical characters and symbols) can be represented by selective excitation of individual display segments. For example, by exciting the display segments 22 and 23, the digit 1 can be represented; by exciting the indicating segments 28, 22, 26, 25 and 24 the digit 2 can be represented, etc. A prerequisite for the lighting up of the excited segments is that a character-control signal is applied to an additional character-control input 50*a* 50*b*.

The data to be decoded by the decoder 21 are fed to it from a buffer store 30 which receives the data to be displayed at a data input 31. Under control of control signals, which are fed to a control input 32, the buffer store 30 successively generates the data to be displayed by the individual characters 29*a* to 29*d* of the display device 29.

Connected to the complementary output 12 of the sixth stage of the shift register 1, at which the binary signal complementary to the direct output 12 of this stage always appears, it an input of an AND gate 33 whose other input is connected to the direct output 13 of the seventh stage of the shift register 1. The output of the AND gate 33 is connected to the timing input 34 of a ring counter 35, which produces successively at its outputs 36 to 39 a control signal with the logic value 1.

The ring counter 35 includes a shift register 40 whose stage outputs form directly the ring counter outputs 36 to 39. To make sure that this shift register 40 functions as a ring counter, that is, produces a control signal at its outputs in cyclical succession, the first three stage outputs of the shift register are returned to the signal input 42 by a NAND gate 60. Due to this connection, the logic value 1 recirculates through the shift register. It is naturally also possible to use other connections, for the ring counter 35, as long as it produces the desired function. The outputs 36 to 39 of the ring counter 35 are connected to inverters 54 to 57, whose outputs are connected to the signal inputs of AND gates 43 to 46; the other inputs of these AND gates are connected to the output 47 of an OR gate 48. One input of this OR gate 48 is connected to the direct output 7 of the first stage of the shift register 1, the other input of the OR gate 48 is connected to the direct output 13 of the final stage of this shift register 1. The output 49 of the AND gate 43 is connected to the character selection input 50*a* for the first character 29*a* of the display device 29, and the outputs 51, 52 and 53 are connected to corresponding character selection inputs 50*b*, 50*c* and 50*d* for the other positions 29*b*–29*d* of the display device 29.

The control signals fed to the control input 32 of the buffer store 30 are derived from OR gates 58 and 59; a first input of each of these OR gates is connected to the output of the inverter 57, while the second input of the OR gates 58 and 59 are connected to the outputs of the inverters 56 and 55, respectively. As a result of this connection, the two outputs of the OR gates 58, 59 produce combinations of control signals which provide clear information as to which of the four inverters 54 to 57 is producing a control signal. Since the control signals at the inverter outputs in conjunction with the AND gates 43 to 46 which character 29*a* and 29*d* of the display device 29 is to be triggered, the buffer store 30 can apply to the decoder 31 the data for the character to be triggered on the basis of the control signals fed to it.

The manner of operation of the circuit represented in FIG. 1 will be described with reference to FIG. 2 which is a pulse sequence diagram pertinent to operation of the circuit of FIG. 1. Each pulse is designated by the letter S followed by the reference number of the associated circuit location; for example, the signal at the timing input 5 is designated by S5.

Assume that the shift register 1 is empty, that is, it produces logic 0 signal levels at its direct outputs 7 to 13. The buffer store 30 contains coded data which correspond to the digits of a four digit number to be represented by the display device 29. Data corresponding to the digit to be displayed by the character 29*a* is fed from the store 30 to the decoder 21, which produces segment control signals at those of its seven outputs which correspond to the segments required for displaying this digit. Finally it is assumed that the ring counter 35 produces at its output 36 a logic 1 signal level, and at its outputs 37, 38 and 39 the logic 0 signal levels. Under this condition, the AND gate 43 is enabled.

The timing signal generator 6 continuously produces timing pulses at the timing input 5 of the shift register 1. The switching signal generator 4 also feeds to the signal input 2 of this shift register, periodically recurring pulses S2 whose duration is much longer than the duration of the timing pulses. With the first trailing edge of a timing pulse S5 after the transition of the pulse S2 to the logic 1 level, the first stage of the shift register 1 is set so that its direct output 7 produces a control signal S7 having a logic 1 level. The individual stages of the shift register 1 thus are set in synchronism with the timing pulses S5, so that their direct outputs 8 to 13 produce control signals S8 to S13 with a logic 1 level, staggered by one period of the timing pulses S5. On termination of an impulse S2, the individual stages of the shift register 1 are reset successively in synchronism with the timing pulses S5 to a state in which the control signals S7 to S13 given off by them assume the logic 0 level.

During the logic 1 level condition of the control signals S7 to S13, the respective gate circuits 14 to 20 are enabled for the transmission of the segment control signals produced by the decoder 21.

As soon as the control signal S7 assumes the logic 1 level, the OR gate 48 produces at its output 47 a logic 1 output pulse S47 which lasts until the control signal S13 again assumes the logic 0 level. The duration of output pulse S47 determines the duration of the application of the character control signal S49 to the character control input 50*a* of the character 29*a* of the display device 29. An output pulse S49 is obtained from the AND gate 43 when it is enabled by a control pulse 36.

The individual segments in each character 29*a*, 29*b*, 29*c* and 29*d* of the display device 29 can only light up if a segment control signal is fed to them and a character control signal is applied to the respective character control input 50*a*, 50*b*, 50*c* and 50*d*. The segment control signals transmitted over the AND gates 14 to 20 are applied in parallel to all four characters 29*a* to 29*d* of the display device 29, but only the segments of the position 29*a* can light up, because a character control signal is fed only to the character control input 50*a* of this character. Since this character control signal S49 exists from the commencement of the logic 1 level (leading edge) of the control pulse S7 to the end of the logic 1 level (trailing edge) of the control signal S13, it can be seen that the segment 22, for example, can light up immediately after transition of the control pulse S7 to the logic 1 level, if the decoder 21 produces a segment control signal for this segment, as is the case, for example, in the display of the digit 1, while the second segment 23 required for the display of this digit can only light up when the control pulse S8 assumes the logic 1 level. When this digit 1 is displayed, the segment 22 lights up together with the appearance of the logic 1 level of the control pulse S7 and the segment 23 lights up, staggered in time by one period of the timing impulses S5. Additional segments required for displaying other digits also light up staggered in time, the interval corresponding to the staggering of the associated control pulses S7 to S13. Due to the staggered application of the segment control signals to the display segments, only the current necessary to make a single indicating segment light up has to be switched. When the individual display segments are switched off, only the current value necessary for one display segment has to be switched, due to the staggering of the segment control signals.

Figure 2:
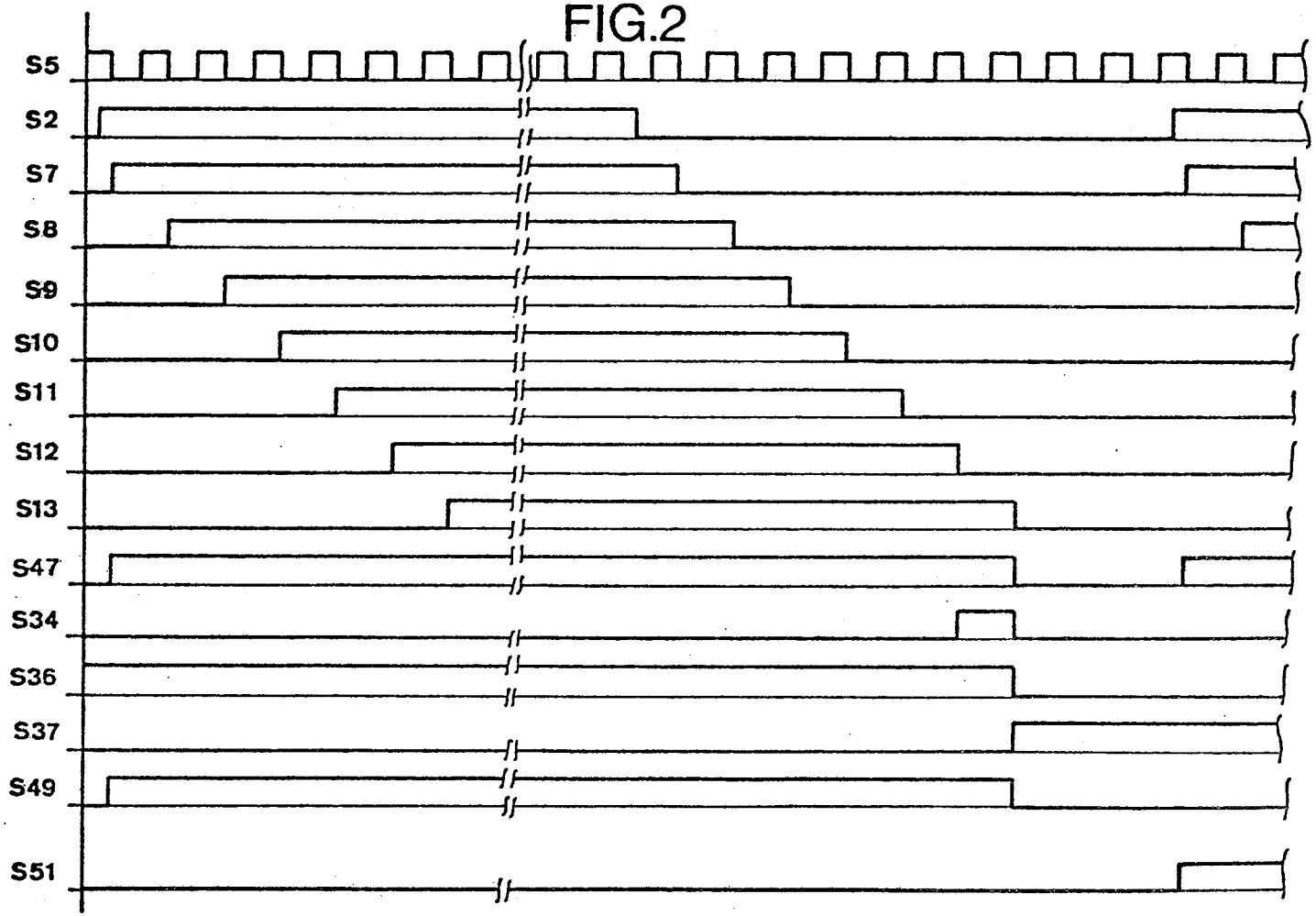
FIG. 2 is a pulse diagram pertinent to the operation of the circuit arrangement of FIG. 1.

The interruption of the time axis in FIG. 2 indicates that the time during which the segments required for representing a certain number are to light up, is much shorter than could be represented in the scale of the diagram of FIG. 2. During the entire duration of the pulse S2 produced by the switching pulse generator 4, a logic 1 level is fed into the shift register 1 and shifted through the latter, so that the individual stages of this shift register are set in succession, then held in the set state 1 for a relatively long time corresponding substantially to the desired light up period of character 29*a* of the display device, and finally, when the pulse S2 ceases, the stages are reset again in succession. Subsequently, care must be taken that only one digit is indicated in the next character 29*b* of the display device 29. This is achieved primarily by means of the ring counter 35. This ring counter 35 receives from the output of the AND gate 33 a timing impulse S34 when the last stage of the shift register is still set at logic level 1, while the second last stage has already been reset. The ring counter 35 is thus stepped up by one step, so that it now produces at the output 37 a control signal S37 which enables the AND gate 44 while the previously enabled AND gate 43 is disabled. At the next output signal from the OR gate 48, a character control pulse S51 is thus applied to the character control input 50*b* of the next character 29*b* of the display device 29, so that only the segments of this character can light up corresponding to the segment control signals produced by the decoder 21.

After each complete operating cycle of the shift register 1, which is started and ended by a pulse S2 from the switching signal generator, a switch occurs from one character of the display device to the next as explained above. The circuit of FIG. 1 is designed to control a four character display and consequently, the ring counter 35 has four stages, so that, after the fourth pulse has been shifted through the shift register 1, the first character of the display device is controlled again. To ensure that different digits can be displayed at the various characters of the display device, the buffer store 30 must be so switched, together with the switching from one character to the next, that only those of the data stored which correspond to the digit to be displayed at the next character are supplied to the decoder. For this switching of the buffer store 30 the pulses produced by the AND gates 43 to 46 can be used, these pulses also being fed to the control input 32 of the buffer store 30. This ensures that during switching from one character of the display device to the next, the data destined for this character also is fed to the decoder.

In order to simulate a continuous lighting up of the individual digits in the above described multiplexed switching operation of the display device 29, the switching frequency of the individual characters 29*a*, 29*b*, 29*c* and 29*d* should be so selected that the eye does not perceive the interruptions. This switching frequency corresponds to the repetition frequency of each of the character control pulses S49, S51 . . . in the above described example, hence to one quarter of the repetition frequency of the pulses S2 produced by the switching signal generator 4.

Though in this type of triggering of a display device the current feed to the individual characters is constantly connected and disconnected, no marked HF interference appears during operation of the switching circuit described above, since only the current value which is required to make a single segment light up has to be switched at each switching operation. The above described arrangement is thus particularly suitable for applications requiring avoidance or minimization of HF interference.

In a practical circuit, the following integrated circuits of Texas Instruments Incorporated, Dallas, Texas, were used:

for the shift register 1: SN74164N
for the shift register 40: SN74164N
for the decoder 21: SN74143N
for the buffer store 30: SN7417N.

For the switching signal generator 4 and the timing generator 6 can be used a conventional multivibrator circuit, as shown, for example, in "Taschenbuch der Hochfrequenztechnik" (Handbook of high frequency engineering) 2nd edition, 1962, p. 10179. The frequency determining switching elements in these multivibrators are so designed that the switching signal generator operates at a frequency of 1 MHz, while for the timing generator 6 a frequency of 1 kMz is selected.

What is claimed is:

1. Control circuit for a display device comprising a plurality of display segments selectively actuable to display desired characters, including segment actuation circuit means for producing output signals according to a character to be displayed, first control circuit means for producing in sequential time overlapping relation, a plurality of equal duration control signals equal in number to said plurality of segments, and means operably responsive to said control signals to supply said output signals to selectively actuate said segments in sequence to cause a display by said display device having the appearance of a complete character.

2. Control circuit according to claim 1, wherein said first control circuit includes a shift register having a plurality of stages corresponding in number to said plurality of segments, each said stage having an output, and a like plurality of logic gates having first inputs connected to respective ones of said shift register stage outputs and second inputs connected to said actuation circuit means for receiving respective ones of said output signals therefrom, said logic gates having outputs connected to respective ones of said segments.

3. Control circuit arrangement according to claim 2, further including switching signal generator means for generating switching signals each having the same duration at least equal to a predetermined duration of application of a said output signal from said actuation circuit means to a said display segment, said switching signal generator means connected to supply said switching signals to a signal input of said shift register, and timing generator means connected to supply timing (shift) signals to said shift register, said timing signals having a repetition frequency that is high compared to that of said switching signals whereby said display segments are actuated in rapid sequence.

4. Control circuit arrangement for a multi-character display comprising a plurality of display devices, each said display device comprising a plurality of display segments selectively actuable to display desired characters and each said display device including a terminal common to all display segments of said display device, segment actuation circuit means for producing output signals according to a character to be displayed, first control circuit means for producing in sequential time overlapping relation a plurality of equal duration control signals equal in number to the plurality of display segments of a display device, and means operably responsive to said control signals to apply said output signals in sequence to corresponding display segments of all said display devices, a plurality of coincidence gate circuits having outputs connected to said common terminals of said respective display devices, and means for sequentially actuating said coincidence gate circuits to apply in sequence to the common terminals of said display devices selection signals each having a duration corresponding to the overall duration of a said plurality of said equal duration control signals thereby operating each of said display devices in sequence and also operating in sequence the selected display segments of an operated display device to give the appearance of simultaneous display of a set of complete characters by said multi-character display.

5. Control circuit arrangement for a multi-character display comprising a plurality of display devices, each display device comprising a plurality of display segments and a terminal common to all of the segments of that display device, display segment actuation circuit means having a plurality of outputs corresponding in number to the plurality of display segments of a display device, means for selectively enabling for a predetermined duration said outputs according to a character to be displayed, shift register means having a plurality of stages corresponding in number to the number of display segments of a display device, each stage of said shift register having an individual output, a plurality of coincidence gates having outputs connected respectively to corresponding ones of the display segments of all of said display devices, said coincidence gates having first inputs connected to respective outputs of said actuation circuit means and second inputs connected to respective stage outputs of said shift register means, switching generator means for generating switching signals each having an identical duration at least equal to the duration of an output signal from said actuation circuit means, means connected to apply said switching signals to an input of said shift register, timing signal generator means for generating timing signals at a frequency that is high relative to the frequency of said switching signals, means connected to apply said timing signals to a shift input of said shift register to generate at said stage outputs successive cycles of time overlapping, identical duration control signals, a second plurality of coincidence gates having outputs connected to respective ones of said common terminals, said second coincidence gates each having a first input connected to said shift register for enablement over a period corresponding to the duration of a cycle of said control pulses, said second coincidence gates each having a second input connected to second control circuit means for generating pulses for successive enablement of said coincidence gates each for a period corresponding to the duration of said cycle of control pulses, and means operably connecting said second control circuit means to said actuating circuit means for synchronizing operation thereof.

6. Circuit arrangement according to claim 5, including OR gate means having an output connected to the first input of each of said second coincidence gates, said OR gate having first and second inputs connected respectively to the stage outputs of the first and last stages of said shift register means.

7. Circuit arrangement according to claim 5, wherein said second control circuit includes recirculating shift register means operably controlled by said first mentioned shift register means.

8. Circuit arrangement according to claim 5, wherein said actuation circuit means comprises means for storing the signal information corresponding to characters to be displayed by said display devices, and decoder means connected to said store means for producing said plurality of outputs.

9. Circuit arrangement according to claim 5, wherein said display devices comprise light emitting diodes.

* * * * *